United States Patent [19]

Mitsui

[11] 4,386,565

[45] Jun. 7, 1983

[54] PRINTER APPARATUS USING ELECTROMAGNET

[75] Inventor: Yoshihiro Mitsui, Shiojiri, Japan

[73] Assignees: Shinshu Seiki Kabushiki Kaisha; Kabushiki Kaisha Suwa Seikosha, both of Tokyo, Japan

[21] Appl. No.: 204,732

[22] Filed: Nov. 6, 1980

[30] Foreign Application Priority Data

Nov. 6, 1979 [JP] Japan ..... 54-143709

[51] Int. Cl.[3] ..... B41J 3/04; B41J 9/36

[52] U.S. Cl. ..... 101/93.34; 101/93.29

[58] Field of Search ..... 101/93.33, 93.34, 93.36, 101/93.31, 93.29; 335/170–171, 253

[56] References Cited

U.S. PATENT DOCUMENTS 3,049,990 12/1960 Brown et al. ..... 101/93
3,188,946 6/1965 Schacht ..... 101/93.34
3,335,659 7/1967 Schacht et al. ..... 101/93
3,838,638 10/1974 Clary ..... 101/93.34 X
3,977,509 8/1976 Leersnijder ..... 101/93.33 X
4,077,505 3/1978 Giolitti ..... 101/93.34 X

*Primary Examiner*—A. J. Heinz
*Attorney, Agent, or Firm*—Blum, Kaplan, Friedman, Silberman & Beran

[57] ABSTRACT

A printer of the needle or hammer impact type prints by release of spring-stored energy, driving the needle or hammer against a platen or character ring. A rotating cam restores the printing member to a locked standby condition after impact, and an electromagnet attracts a moveable core to allow release of the printing member at selected times for printing. The gap between the moveable and fixed cores of the electromagnet is periodically closed mechanically and electrical energization of the electromagnet only maintains the attracted state of the fixed and moveable cores.

9 Claims, 8 Drawing Figures

PRINTER APPARATUS USING ELECTROMAGNET

BACKGROUND OF THE INVENTION

This invention relates generally to a printer of the type used for an electronic calculator, and the like, and more particularly to a printer using an electromagnet and having small size and low electrical energy consumption. In such applications as electronic calculators, an electromagnet, that is, a solenoid device has become an indispensable element for achieving reduced size and low energy input. However, the electromagnet is a principal part which consumes power in a printer and electromagnets suffer from many defficiencies. For example, efficiency is low and energy consumption is large in terms of the work accomplished. Peak current is high, which affects the size and life of the battery power supply which is conventionally used in portable calculators with printers. Also, the time required to actuate the electromagnet and attract a moveable element varies as the applied voltage varies in magnitude.

The problems of efficiency and peak current are resolved by making the electromagnet large. The problems of peak current and operation time are resolved by using a nickel-cadmium cell having a small internal resistance and a stable discharge characteristic. However, when using these solutions it is not possible to miniaturize the printer sufficiently to obtain a pocket-sized calculator with printer. Also, it is not possible to sufficiently lower power consumption of the printer so that it may be driven by an inexpensive consumable manganese cell (Mn). The manganese cell has an internal resistance which is larger than the nickel-cadmium cell and the discharge characteristic is less refined and uniform.

What is needed is a printer using an electromagnet which can operate on less expensive manganese cells and have small sized, efficient and uniform operation.

SUMMARY OF THE INVENTION

Generally speaking, in accordance with the invention, a printer using an electromagnet and especially suitable for small-sized calculators and operation on low-cost batteries is provided. A needle or hammer impact-type printer prints by release of spring-stored energy, driving the needle or hamme4r against a platen or character ring. A rotating cam restores the printing member to a locked standby condition after impact, and the electromagnet attracts a moveable core to allow release of the printing member at selected times for printing. The gap between the moveable and fixed cores of the electromagnet is periodically closed mechanically and electrical energization of the electromagnet only maintains the attracted state of the fixed and moveable cores. Operation is uniform over a wide range of input voltages. A rotating mechanical device closes the gap in the electromagnet eliminating the need for electrical energy at the conditions of most inefficient operation of the electromagnet. Electrical energy is applied to the electromagnet only when the cores of the electromagnet are in position for efficient operation. Thereby, electrical energy is conserved.

Accordingly, it is an object of this invention to provide an improved printer having an electromagnet as part of the drive and release mechanism for the printers impact member.

Another object of this invention is to provide an improved printer which minimizes the energy consumption of the electromagnet which is part of the printing mechanism.

A further object of this invention is to provide an improved printer wherein an electromagnet requiring reduced magneto-motive force is used and size and peak current are reduced.

Still another object of this invention is to provide an improved printer wherein operating time and energy required for printing are independent of input voltage variations.

Yet another object of this invention is to provide an improved printer using an electromagnet having uniform operational time and power requirements even when the gap between the fixed and moveable cores is variable.

Another object of this invention is to provide a printer having an electromagnet which operates on inexpensive manganese cells.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
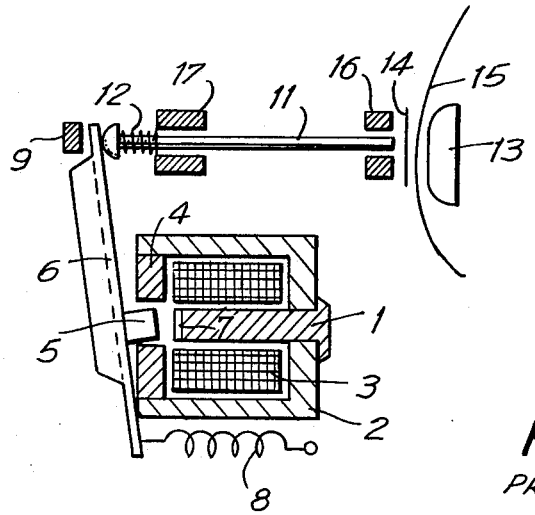
FIG. 1 PRIOR ART
FIG. 1 is a semi-schematic diagram of a dot printer of the prior art using an electromagnet.
Figure 2:
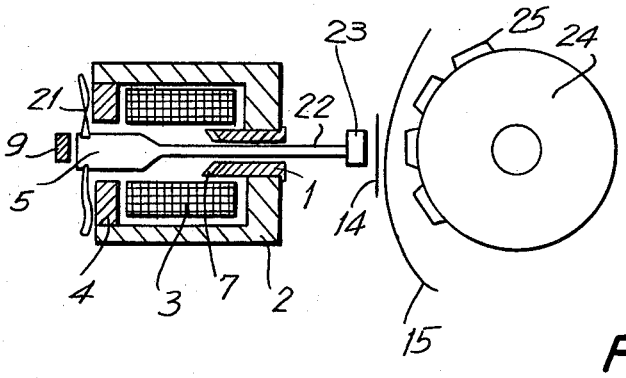
FIG. 2 PRIOR ART
FIG. 2 is a semi-schematic diagram of an impact printer of the prior art using an electromagnet.
Figure 3:
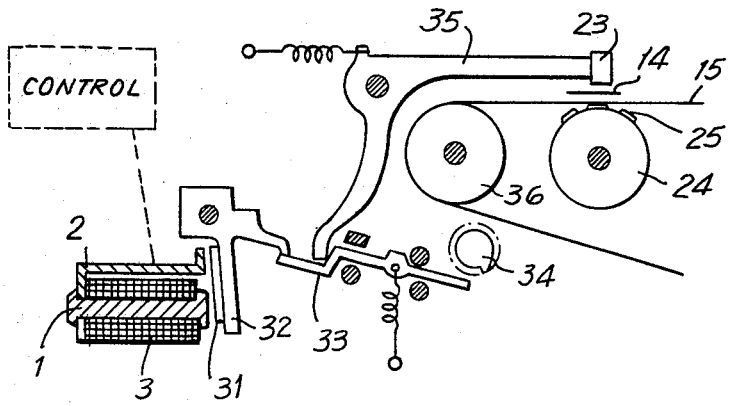
FIG. 3 is a semi-schematic diagram of another impact printer using an electromagnet.

FIGS. 1 through 4 relate to prior art constructions of apparatuses using an electromagnet. In these examples the apparatus is a printer. FIG. 1 is a dot-type printer using a needle for printing. FIG. 2 is a printer having a hammer and a character ring, and FIG. 3 is an improved hammer-type printer using a ratchet wheel in cooperation with an electromagnet to drive the hammer. All of these printers use an electromagnet. Those printers of FIGS. 1 and 2 use the electromagnet directly to provide the energy necessary for printing. In FIG. 3, the energy is obtained from a rotating ratchet or fly wheel which is enabled to deliver its energy by the electromagnet.

With reference to FIG. 1, an electromagnet comprises a fixed core 1 which is positioned on a yoke 2. An upper plate 4 completes the magnetic circuit of the yoke and a magnetic coil 3 is located within the yoke. An operating plate 6 is mounted for pivotable motion against the yoke 2 and includes a core 5 which moves when the plate 6 pivots. A spacer 7 of non-magnetic phosphor bronze attached to the fixed yoke 1 provides a limit to the pivoting motion of the plate 6 when the moveable core and plate 6 are drawn inwardly to the fixed core by electrical energization of the coil 3. Operation and construction are in the conventional manner and need no further description herein. A spring 8 attached at one end of the operating plate 6 holds the plate 6 in a standby condition when the coil 3 is not energized. In the standby condition, the gap between the fixed core 1 and the moveable core 5 is large. A stop 9 limits the return motion of the operating plate 6 due to the force of contraction of the spring 8. A needle 11 is positioned in contact with the far end of the operating plate 6 and held in an aligned position by needle guides 16, 17. A compression spring 12 is constrained between the needle guide 17 and the head of the needle adjacent to the operating plate 6.

Such a simple structure for a dot-type printer using an electromagnet is widely used in the prior art. Operation of the printer of FIG. 1 is explained with reference to FIG. 4. An electrical dot signal 41 in the form of square wave pulses synchronizes the timing for the placement of dots which form a character. In synchronization with the pulses 41, the coil 3 is inputted with an electric driving pulse 42 for energizing the electromagnet. The instantaneous current i, as shown by curve 43, flows through the coil 3 and increases in accordance with the time constant defined by the inductance L and the resistance R of the coil 3. More precisely, the current increases in accordance with the general formula:

$$i=(V/R)(1-e^{-(R/t)t})$$

Where V is the applied voltage and t represents the passage of time.

The attracting force F of the electromagnet 1–4 is represented by the general equation:

$$F=\tfrac{1}{2}U^2(\mu S/X^2)$$

Where U is the magnetomotive force, that is, the product of the instantaneous current i flowing in the coil 3 and the number of turns in the coil 3. S is the facing area of both moveable and fixed cores 5, 1. X is the space or gap between the moveable core 5 and the fixed core 1, and $\mu$ denotes permeability of the magnetic circuit.

The operating plate 6 begins to move after the attractive force F has increased sufficiently and exceeds the force of the springs 8, 12. The curve 44 represents the displacement of the needle 11 and shows the initiation of needle motion as the current i increases. Once motion of the needle 11 begins, the attracting force F increases rapidly because of the increasing current i and the corresponding decrease in the gap X between the moveable core 5 and the fixed core 1. Thereby, the operating plate 6 is rapidly attracted toward the fixed core 1. The needle 11 begins to fly, that is, move toward a platen 13, in a manner similar to the movement of the operating plate 6. The needle 11 is driven with a delay 45 from the leading edge of the electromagnet driving pulse 42. As stated above, the delay represents the time when the attractive force F builds up to overcome the forces of the springs 8, 12.

After a period 46, the needle 11 strikes the platen 13 through an ink ribbon 14 and a sheet of paper 15. Thereby printing is performed on the paper 15. After the trailing edge of the electromagnet driving pulse 42, which occurs approximately at the same time as the needle 11 striking the platen 13, the coil 3 is de-energized.

The needle 11 returns to its standby position as a result of the replusive force due to the impact of the needle 11 against the platen 13, and as a result of the force of the needle spring 12 and return spring 8 which dominates the motion after the coil 3 has been de-energized. By this rapid return motion of the needle 11, breakage of the needle 11 is avoided and the ink ribbon 14 is not damaged.

Using such an electromagnet and surrounding mechanical structure, it is not possible to use a small electromagnet or to reduce the power consumption of the electromagnet so as to use an inexpensive manganese cell. Such a construction has the following additional disadvantages. It is desirable to reduce the gap between the moveable core 5 and the fixed core 1, however, physical requirements of the structure to give sufficient motion to the needle 11 limits the possible reduction in gap. Therefore, the magnetomotive force U cannot be reduced below a certain value.

Under existing constructions, the gap between the moveable core 5 and the fixed core 1 is 0.3 mm (millimeters) and the gap is set with a tolerance of $\pm 0.03$ mm. The distance from the free end of the needle 11 to the platen 13 must be in the order of 0.5 to 0.6 mm to permit a free feeding of the paper 15 and the ink ribbon 14. Any lack of stroke of the moveable core 5 must be compensated for by the ratio of the length from the axis of rotation of the plate 6 to the moveable core 5 and from the axis to the driving portion at the needle end of the operating plate 6. When further decreasing the gap, the inertia of the operating plate 6 increases and the flying or advancing time 46 for the needle 11 is further increased and printing speed is reduced. Thus, it is necessary to balance the need for high attractive force F and high printing speed.

Another disadvantage in the construction of FIG. 1 is the need for an increased magnetomotive force so that fluctuations in the gap between the fixed and moveable cores, and fluctuations in the applied voltage can be disregarded. In other words, the magnetomotive force must be sufficient to operate the needle 11 under the worst voltage conditions and with the most unfavorable gap distance. The needle 11 must fly, that is, move to impact, in a selected period of time so as to print on the paper 15 at the proper position. Accordingly, even when the gap and voltage applied vary, the needle 11 must arrive at the paper 15 with no more delay than is shown in curve 44 with the broken line. As anticipated from the formula of the attracting force F, there must be sufficient magnetomotive force U even when there are gap fluctuations and the current changes i are not exactly to design values.

When an ink ribbon 14 is used, the energy required for printing depends on the thickness of the ink ribbon 14, and the quality and the number of layers of paper 15. Because the printing energy is obtained directly from the electromagnet in the construction of FIG. 1, energy consumption of the electromagnet is large. The electromagnet is very inefficient in consuming electrical energy. Although the printing energy requires 0.1 mJ to clearly print a dot on a single sheet of paper 15, the magnet requires an input energy greater than three mJ (milli-Joules). The efficiency of the electromagnet is generally in the order of only 2 to 3 percent.

When four manganese cells are used and the terminal voltage is four volts, and the pulse width of the electromagnet driving pulse 42 is 0.5 milli-seconds, the current i is defined as $i=3/(4\times0.5)=1.5$ A. When the internal resistance and contact resistance of the manganese cells are taken into consideration, and a resistance of approximately 2 ohms is normal for four manganese cells, it is not possible to use such manganese cells. Further, since it is usual that a plurality of needles 11 are driven simultaneously, and each needle 11 uses an independent electromagnet, the current drain is exceedingly high for manganese cells. There are other disadvantages to the prior art printers as shown in FIG. 1. It is necessary to prevent double printing and needle breakage by providing a compensating circuit to assure a constant energy delivery by the electromagnet. With reference to waveform 43 (FIG. 4), the portion 47 of the curve represents the time when the gap is at a minimum. If the coil 3 of the electromagnet is energized for a longer period of time, that is, to the time shown by the broken line 48, the needle 11 which bounces from the platen 13 is again attracted. The needle 11 strikes twice against the plate 13 as indicated by the broken lines 49 in the curve of needle displacement 44. In other instances, rather than striking twice against the platen 13, the needle 11 is caught by the ink ribbon 14 and broken. Thus, it is necessary that the coil 3 be de-energized immediately after the needle 11 strikes the platen 13. Further, it is necessary to provide a constant energy compensating circuit to adjust for voltage changes and fluctuations in the gap.

In the electromagnet of FIG. 1, it is difficult to maintain the gap constant, which causes reliability problems over a long time. In order to maintain the tolerance of the gap in the range of $\pm0.03$ millimeters for a gap of 0.3 millimeters, accuracy in producing the parts must be improved and the manufacturing process increases in complexity to properly combine the moveable and fixed portions of the electromagnet within the desired range of tolerance. In view of the changes in the magnitude of the gap due to aging, the magnetomotive force must be over and above that required for nominally designed operation.

Figure 4:
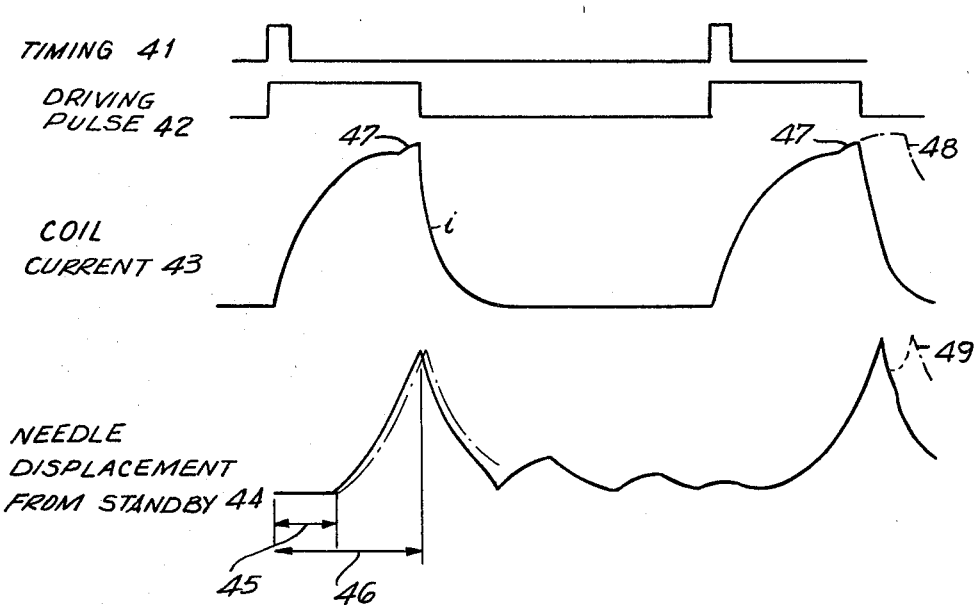
FIG. 4 PRIOR ART
FIG. 4 is waveforms showing the relationships between electrical signals and mechanical motions in the prior art printers of FIGS. 1–3.

Next, the printer shown in FIG. 2 is described with parts serving the same functions as those parts in FIG. 1 having the same reference numerals. In the printer of FIG. 2, a hammer 23 strikes against characters 25 for printing. The hammer 23 is connected to a moveable core 5 by means of an extended rod 22. This assembly 5, 22, 23 moves within the fixed core 1 and when a coil 3 is energized, the hammer 23 is driven against a character 25 on a character wheel 24 with a web of paper 15 and ink ribbon 14 therebetween. A spring 21 returns the moveable core 5 to a standby position after printing when the coil 3 is de-energized. As seen in FIG. 2, the characters 25, for example, letters and symbols, are arranged around the periphery and elevated above the character ring 24. The waveforms of FIG. 4 are applicable to this printer of FIG. 2 when considering the dot timing signal 41 is replaced with a character signal defining the position of a character on the character ring which rotates. The waveform 44 showing the movement of the needle 11 is similar to the displacement of the hammer 23 in FIG. 2.

In addition to having the disadvantages described in relation to the electromagnet and printer structure of FIG. 1, the printer of FIG. 2 has a further disadvantage in that it requires greater energy than the dot printer of FIG. 1. The required stroke of the hammer 23 is in the order of 0.5 to 0.6 mm and this corresponds to the gap between the moveable core 5 and the fixed core 1. Accordingly, $(0.5 \text{ to } 0.6/0.3)^2=2.8$ to 4 times the magnetomotive force U is required in the electromagnet of FIG. 2 as compared to the electromagnet shown in FIG. 1.

FIG. 3 is an advanced design of a printer in which the operating force is mechanically amplified. The electromagnet includes a fixed core 1, a yoke 2, a coil 3 and an attractable plate 31 of magnetic material. An operating plate 32 is connected to the attractable plate 31 and makes contact with a trigger bar 33. The printer also includes a rotating ratchet wheel 34 and a hammer body 35.

When the coil 3 is energized, the attractable plate 31 is drawn to the fixed core 1, pivoting about a fixed axis, and the operating plate 32 acts to pivot the trigger bar 33 such that the end of the trigger bar 33 falls within the locus of the ratchet wheel 34. When the trigger bar 33 is struck by the rotating ratchet wheel 34, the trigger bar 33 is driven causing the hammer body 35 to pivot about a fixed axis causing the hammer 23 to descend and strike a character 25 on the character ring 24 through the ink ribbon 14 and the paper 15. Thereby printing of the character on the paper 15 is accomplished. The paper 15 is advanced by the roller 36.

Because the operating force is mechanically amplified by deriving energy from the rotating ratchet wheel 34, the ratio of the energy actually used in printing to the energy consumption of the electromagnet is improved, that is, larger as compared to the electromagnets shown in FIGS. 1 and 2. However, the efficiency of the electromagnet itself is not improved. In order to achieve a larger attractive force, the gap between the core 1 and the attractable plate 31 must be reduced. If the gap is reduced, the ratio of the lever effects for the operating plate 32 and trigger bar 33 need to be increased, and the mass of these components is increased. This causes an increased inertia of these parts and a reduction in printing speed. Therefore, it is necessary to balance the attractive force requirements against the printing speed as described in the above embodiments of FIGS. 1 and 2. However, the printer of FIG. 3 does not require a constant energy compensating circuit as in the printers of FIGS. 1 and 2.

As stated above, using conventional electromagnets and structures, it was not possible to reduce the size of the electromagnet, reduce power consumption and drive the printer with an inexpensive manganese cell. Even when the accuracy in production of parts is improved, it is not possible to use manganese cells. An embodiment of a dot-type printer in accordance with this invention, which eliminates the disadvantages described above is shown in FIG. 5 with the related waveforms shown in FIG. 6.

Figure 5:
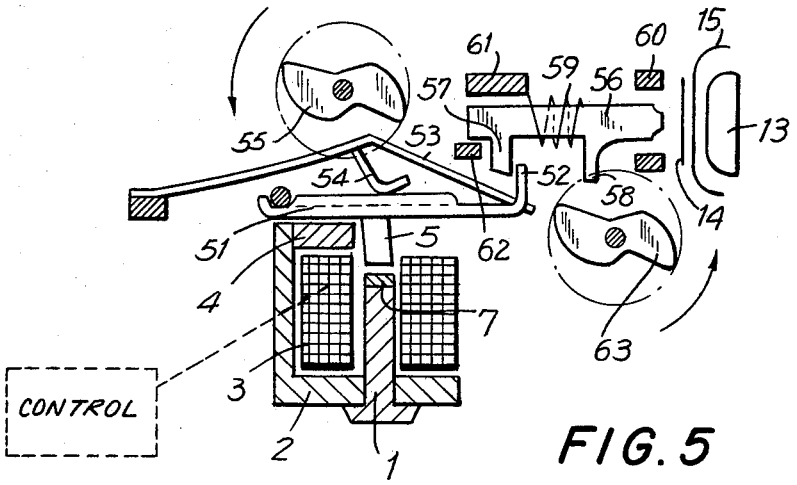
FIG. 5 is a semi-schematic diagram of a dot-type printer in accordance with this invention and using an electromagnet assembly.

In FIG. 5, the electromagnet, is comprised of a fixed core 1, yoke 2, coil 3 and moveable core 5. The moveable core 5 is attached to an operating plate 51 which is pivotably mounted such that it is drawn towards the fixed core 1 when the coil 3 is energized. A needle 56 is used to impact against a platen 13 with a printing paper 15 and an ink ribbon 14 located therebetween. An end portion 52 of the operating plate 51 engages with a projection 57 extending laterally from the needle 56. It is not possible for the needle 56 to move toward the platen 13 while the engaging portion 52 of the operating plate 51 obstructs the projection 57 of the needle 56. It should also be understood that in an alternative embodiment the engaging portion 52 may enter a recess in the needle 56 to block the needle motion. A spring 53 acts to hold the operating plate in a standby position, that is, with a gap between the moving core 5 and fixed core 1. The spring 53 engages with the plate 51 near the engaging portion 52. A spring 54, which is one piece with the spring 53, extends down toward the center of the operating plate 51 opposite to the moveable core 5.

A portion of the spring 53 extends up into the locus of rotation of a rotating cam 55. Twice in each revolution of the rotating cam 55, the spring 53 is deflected downwardly such that the spring 54 pushes against the plate 51 until the moveable core 5 positively contacts a spacer 7 located at the end of the fixed core 1. Needle guides 60, 61 and 62 align the needle 56 transversely to the platen 13 and the needle guide 62 also serves as a stop for the needle 56 as it returns after impacting against the platen 13. A compression spring 59 is positioned between the needle guide 61 and a projection 58 such that when the needle 56 is clear of the engaging portion 52 on the plate 51, the needle flies, that is, moves rapidly in the direction of the platen 13. A rotating cam 63 makes contact with the projection 58 on the needle 56 when the needle is in an advanced position in contact with the paper 15 and platen 13 so as to drive the needle 56 away from the platen 13, back to the standby position indicated in FIG. 5.

Figure 6:
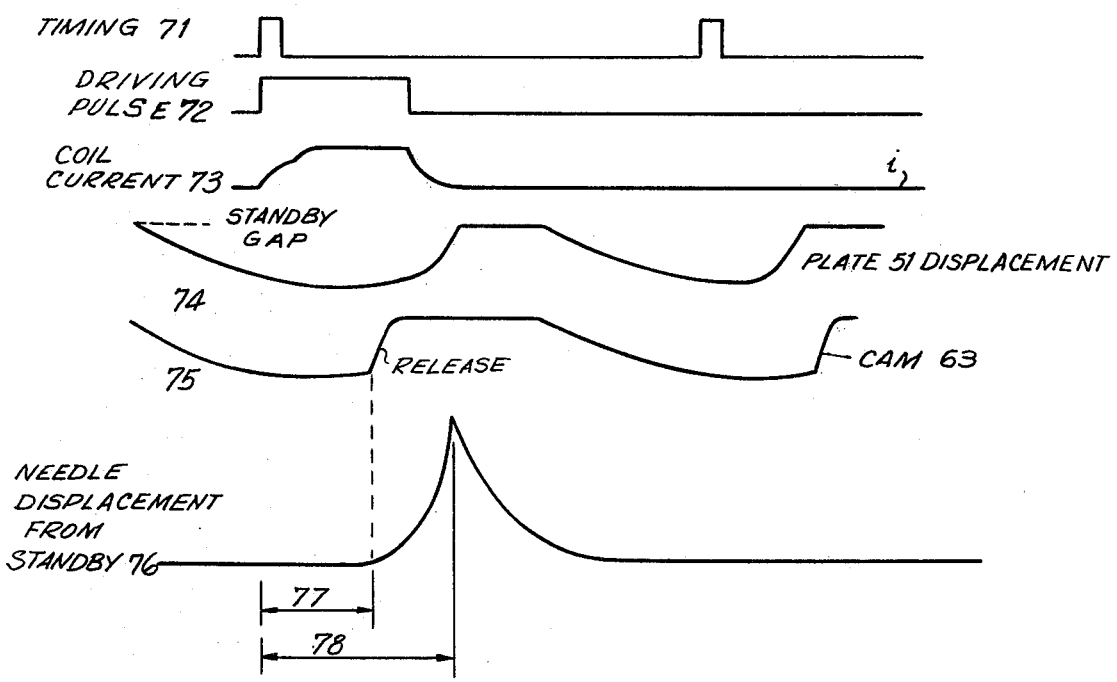
FIG. 6 is waveforms showing the interrelationships between electrical inputs and mechanical motions in the printer of FIG. 5.

Operation of the printer in accordance with this invention (FIG. 5) is explained hereinafter with reference to FIG. 6. Curve 71 shows pulses for timing the printing of dots on the paper by means of the needle 56. Curve 72 is the electrical driving pulse applied to the electrical magnet, particularly to the coil 3, when it is desired to print a dot by means of the needle 56. Curve 73 shows the instantaneous current i in the coil 3 when the voltage signal 72 is applied. Displacement of the needle 56 from a standby position is shown by curve 76.

When the rotating cam 63 is in contact with the projection 58, the needle 56 is pushed back from the platen 13 toward the stop 62. During that period, the tapered lower edge of the projection 57 slides behind the engaging portion 52 so that the needle is prevented from advancing until the coil 3 is again energized. Obviously, only when both the cam 63 is disengaged from the projection 58 and the plate 51 is depressed by the cam 55 can the needle 56 fly to the platen 13. The cams 55 and 63 are synchronized in their rotation such that, as explained more fully hereinafter, unless the coil 3 is energized, the needle 56 is restrained from printing by either of the cam 63 or the engagement of the portion 52 with the projection 57. It should be understood that the spring 53 follows the contours of the cam 55 until it is entirely released. The plate 51 rises as the spring 53 is released.

When the cam 55 rotates, as indicated by the arrow of FIG. 5, the moveable core 5 is moved down by the action of the springs 53, 54 until the gap between the moveable core 5 and the fixed core 1 is reduced to the thickness of the spacer 7, that is, in the order of 0.03 millimeters. The spacer thickness is determined in accordance with the abrasion received by the spacer and the amount of residual magnetism in the magnetic circuit. At this time, engagement between the engaging portion 52 of the attractable plate 51 and the projection 57 of the needle 56 is released. If printing is desired, at this time the electromagnetic driving pulse 72 is applied to the coil 3 so as to maintain the depressed condition of the fixed core 1 against the spacer 7 and at its closest point to the fixed core 1. This condition is maintained by the electromagnet even when the cam 55 is no longer in a position to maintain this physical condition. As soon as the cam 63 rotates to a position of disengagement from the projection 58 of the needle 56, the needle 56 begins to fly, that is, rapidly advance, toward the platen, propelled by the compressed spring 59. There is a delay 77 from the leading edge of the dot signal 71 until the needle 56 begins its advance toward the platen 13. After an elapsed period of time 78 from the leading edge of the dot timing signal 71, the needle 56 hits against the platen 13 with the paper 15 and ink ribbon 14 therebetween so as to perform printing on the paper 15. Then, the needle 56 is returned by the cam 63 engaging the projection 58 on the needle 56. In the return of the needle 56, the spring 59 is compressed as it opposes the return motion of the needle 56. By this time the coil 3 has been de-energized and plate 51 is in its elevated position such that it once again engages the projection 57 of the needle 56 to prevent advancement of the needle 56 until another print timing signal 71 is present.

It should be apparent that the cam 55 will act upon the springs 53, 54 and depress the plate 51 whether printing is desired or not. However, although the plate 51 is depressed and the space between the moveable core and the fixed core 1 is again reduced to make contact with the spacer 7, printing is not performed unless the current flows in the coil 3. The second timing pulse 71 of FIG. 6 illustrates this condition. Without a voltage 72 applied to the coil 3, the plate 51 has returned substantially to the standby condition by the time the cam 63 releases from the projection 58. Thus, at all times during such a cycle the needle 56 is restrained either by the engaging portion 52 of the plate 51 or by the cam 63 acting on the projection 58. Displacements of the plate 51 and cam 63 are shown in curves 74,75 respectively. It is after the constant time 77 that the needle 56 is released from both the engaging portion 52 and cam 63.

Such an assembly of an electromagnet with a mechanical assist has many advantages as follows:

1. The magnetomotive force requirement is extremely small for two reasons. First, the gap between the moveable core 5 and the fixed core 1 is at a reduced condition when the voltage is applied and secondly, the electromagnet does not provide the energy for printing but only the energy for the release of the needle 56 by the action of the attractable plate 51. The gap is reduced to 0.03 millimeters as compared to 0.3 millimeters in the prior art embodiments. Accordingly, a magnetomotive force equivalent to 1/10 of that in the prior art embodiments is enough to obtain an attractive force F of the same value. Also, because the printing energy is not obtained through the attractable plate 51, the stroke of the moveable core 5 and the inertia of the attractable plate 51 can be made small and the requirements for attractive force F can be minimized.

2. The period of time for flying of the needle 56 is constant regardless of voltage changes. The needle 56 starts its forward motion toward the platen 13 when the engagement of the cam 63 with the projection 58 is released. The time period 77 to initiate motion of the needle 56, accordingly is constant regardless of variations in the voltage applied to the coil 3. The time period required for reaching the platen 13, namely, the time difference between the periods 77 and 78, is determined by the spring 59. The force tolerance of such a spring is generally limited within ±10 percent and the spring force is not influenced by changes in applied voltage or ambient temperature. Accordingly, the time during which the needle flies to the platen is also constant.

However, in conventional embodiments, the magnetomotive force varies in proportion to the square of the value of voltage change so that the time for flying of the needle is a variable. Additionally, the time necessary for the attractable plate 51 to move upward is a constant in this invention.

3. Printing energy is a constant because it is not influenced by a change in the voltage applied to the coil 3. Normally, printing energy for each needle depends on the tolerance of the spring 59 and that tolerance is sufficiently small in normal production so that the printing quality for each needle is substantially the same. When as in the present invention, the printing energy does not change although the voltage changes, the printed characters are of substantially the same quality both at the starting voltage and at the lowered voltage at the end of the batteries' useful life. This is true even for a manganese cell wherein the voltage changes greatly as the battery is depleted.

4. The peak current drain of the electromagnet coil 3 is low. This can be seen by comparing curves 73 and 43 of FIGS. 6 and 4 respectively. Peak current in accordance with this invention is reduced to approximately 1/10 of that in the prior art embodiments because the magnetomotive force is reduced. In particular, the gap between the moveable core 5 and the fixed core 1 is diminished and this reduces the requirement for high attractive forces. Thus, the use of a manganese cell is enabled by a lower peak current drain.

5. The electromagnet is small in size and inexpensive. As the magnetomotive force is small and the coil 3 is energized when the gap is already reduced, it is unnecessary to strictly regulate and control the gap at standby conditions. This permits construction of the electromagnet to be small and of low precision.

6. It is unnecessary to provide a constant energy compensating circuit for the electromagnet. The constant energy compensating circuit is required in the prior art for assuring the constant characteristics for release and travel on the needle by supplying the electromagnet with a constant energy amount in spite of voltage changes. This is also unnecessary for preventing the needle from being damaged. Accordingly, it is unnecessary to provide a constant energy compensating circuit which makes the time for energizing the coil vary in proportion to $1/[\text{change in voltage}]^2$.

With the mechanical assist, as shown in FIG. 5, work normally performed inefficiently by the electromagnet is replaced with work more efficiently performed by the rotating cams. In this way the advantages described above are achieved.

Figure 7:
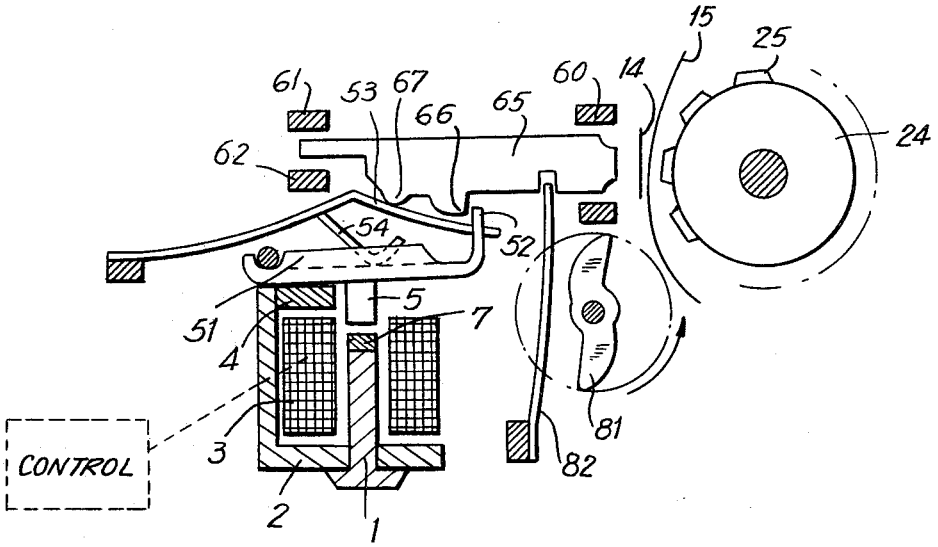
FIG. 7 is a semi-schematic diagram of an alternative embodiment of a hammer-type printer in accordance with this invention using an electromagnet.

An alternative embodiment of a printer using a mechanically assisted electromagnet and having only one rotating cam is described with reference to FIG. 7. The electromagnet 1–5, 7, pivoted attractable plate 51 with an engaging portion 52, and springs 53,54 are similar to the corresponding elements in FIG. 5. A hammer 65 is shown in this construction (FIG. 7) although it should be understood that either a hammer or a needle is equally applicable with the electromagnet constructions of FIGS. 5 and 7. A cam 81 rotates to deflect a spring 82 which is engaged in a recess in the hammer 65. Projections 66, 67 extend from the hammer 65 and guides 60, 61, 62 serve to align the hammer 65 for travel toward the character ring 24 having raised characters 25 on its periphery.

When the cam 81 rotates as indicated by the arrow, the hammer 65 returns to a standby position away from the character ring 24 as the cam 81 pushes against the spring 82. As the hammer 65 moves away from the character ring 24, the projection 67 of the hammer 65 act against the spring 53 and reduces the gap between the moveable core 5 and the fixed core 1 until contact is made with the spacer 7 such that the magnetic gap equals the thickness of the spacer 7. As in the structure of FIG. 5, both springs 53, 54 act in moving the plate 51 so as to close the gap between the moveable and fixed cores 5, 1.

With the core 5 in its depressed position adjacent to the fixed core 1, printing or not printing is determined by whether the coil 3 is energized at that time or not energized. When the coil 3 is energized, engagement between the engaging portion 52 and the projection 66 on the hammer 65 is non-existent to block the motion, and the hammer 65 flies toward the character ring 24 impelled by the spring 82 immediately after the cam 81 reaches a rotational position where it no longer presses against the spring 82.

On the other hand, when the coil 3 is de-energized, the engaging portion 52 rises to re-engage with the projection 66 before the cam 81 releases the spring 82. Thus, either the cam 81 or the engaging portion 52 restrain the forward motion of the hammer 65 during the entire revolution of the cam 81. The hammer is never released to strike the character ring 24.

Figure 8:
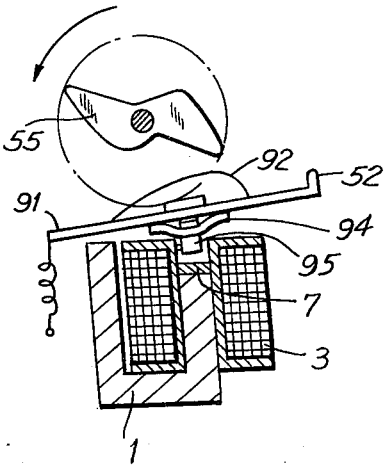
FIG. 8 is a semi-schematic diagram of an electromagnet for use in printers in accordance with this invention.

Another embodiment of a small-sized electromagnet in accordance with this invention is described with reference to FIG. 8. There are several points of difference between this construction and the constructions of FIGS. 5 and 7. An attractable plate 91 is positioned to pivot as described above. The plate 91 is provided with a return spring which opposes the pivoting motion of the plate 91 when the coil 3 is energized. The attractable plate is made of a magnetic material and the upper plate 4 (FIGS. 5, 7) of the yoke is omitted. A movable core 95 is mounted on a spring 94 acting in the direction of the gap, and a projection 92 which is an integral part of the attractable plate 91 is positioned to make contact periodically with a rotating cam 55. When the cam 55 presses against the projection 92, the moveable core 95 is brought down against the spacer 7 and in the process compresses the spring 94. Therefore, the gap is maintained at a minimum but the spring 94 provides for positive upward motion of the movable core 95 when the projection 92 is released by the cam 55.

As described above, in an electromagnet for a printer in accordance with this invention, the power consumption is reduced, operating time is made constant in spite of voltage changes and it is possible to employ a manganese cell to apply to small-sized apparatuses.

Although the mechanically assisted electromagnet in accordance with this invention has been described as adapted for use in a miniaturized printer, it should be apparent that mechanically assisted electromagnets can be applied wherever the inefficiencies of the conventional electromagnet substantially affect the size and performance of the device.

It will be appreciated that where two cam mechanisms are provided in an embodiment, synchronization of their motions is mechanically provided, for example with gearing (not shown). Also, the electrical timing signals are synchronized to the motion of the moving core, for example, by means of a switch providing inputs to a control unit.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also understood that the following claims are intended to cover all of the generic and specific features of the invention herein described and all statements of the scope of the invention which, as a matter of language, might be said to fall therebetween.

What is claimed is:

1. A printer for printing characters on a recording medium, comprising:

an electromagnet including a fixed core, a coil wound around said fixed core, and a movable element, said movable element being attracted to said core when said coil is energized;

an engaging portion being connected to said movable element;

flying means movable independently of said movable element for striking against said recording medium, said flying means including means for connecting said flying means with said engaging portion of said movable element for holding said flying means in a first position spaced from said recording medium and for disconnecting said flying means from said engaging portion to allow said flying means to strike said recording medium;

first mechanical means acting on said movable element for increasing and decreasing the dimensions of a gap existing between said fixed core and said movable element, reduction in said gap dimension causing said engaging portion of said movable element to disconnect from said flying means;

second mechanical means acting on said flying means for resetting said flying means to said first position after advancement of said flying means to said recording medium, and for restraining and releasing said flying means at said first position prior to said advancement, said restraint being terminated and said flying means being released in synchronism with said periodic reduction in said gap dimension between said fixed core and said movable element, energization of said coil being timed to occur while said gap dimension is reduced, said movable element being attracted to said core and held in said position of reduced gap until said coil is de-energized; and means for advancing said flying means toward said recording medium, said advancement being subject to said flying means being free from obstruction and restraint.

2. A printer as claimed in claim 1, wherein said means for varying said gap dimension comprises a cam formed on said flying means, said cam on said flying means acting on said movable element, motion of said flying means causing motion of said movable element.

3. A printer as claimed in claim 1, wherein first said mechanical means for varying said gap dimension includes a first cam.

4. A printer as claimed in claim 3, wherein said second mechanical means for resetting, restraining and releasing includes a second cam.

5. A printer as claimed in claim 4, wherein said first cam for varying said gap dimension acts directly on said movable element.

6. A printer as claimed in claim 4, and further comprising a spring member and wherein said first cam for varying said gap dimension acts on said movable element through said spring member.

7. A printer as claimed in claim 4, wherein said second cam acts directly on a portion of said flying means to restrain said flying means.

8. A printer as claimed in claim 1, wherein said flying means includes a needle for impacting said recording medium.

9. A printer as claimed in claim 1, wherein said flying means includes a hammer for impacting said recording medium.

* * * * *